US008598964B2

(12) United States Patent
Podell

(10) Patent No.: US 8,598,964 B2
(45) Date of Patent: Dec. 3, 2013

(54) BALUN WITH INTERMEDIATE NON-TERMINATED CONDUCTOR

(75) Inventor: Allen F. Podell, Palo Alto, CA (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 13/327,569

(22) Filed: Dec. 15, 2011

(65) Prior Publication Data

US 2013/0154758 A1 Jun. 20, 2013

(51) Int. Cl.
*H01P 5/10* (2006.01)

(52) U.S. Cl.
USPC ..... 333/26; 333/245

(58) Field of Classification Search
USPC ..... 333/25, 26, 33, 160, 236, 243, 245
See application file for complete search history.

(56) References Cited

U.S. PATENT DOCUMENTS

| | | | | |
|---|---|---|---|---|
| 3,103,638 | A | 9/1963 | Greuet | |
| 3,237,130 | A | 2/1966 | Cohn | |
| 3,370,257 | A | 2/1968 | Spierling | |
| 3,428,886 | A | 2/1969 | Kawashima et al. | |
| 3,614,676 | A | 10/1971 | Boelke | |
| 4,222,016 | A | 9/1980 | Stock et al. | |
| 4,554,518 | A | 11/1985 | Baer | |
| 4,700,152 | A * | 10/1987 | Wilson | 333/24 C |
| 4,825,220 | A | 4/1989 | Edward et al. | |
| 5,008,639 | A | 4/1991 | Pavio | |
| 5,121,090 | A | 6/1992 | Garuts et al. | |
| 5,296,823 | A | 3/1994 | Dietrich | |
| 5,304,959 | A | 4/1994 | Wisherd et al. | |
| 5,568,111 | A * | 10/1996 | Metsler | 336/65 |
| 5,697,088 | A | 12/1997 | Gu | |
| 5,977,842 | A | 11/1999 | Brown et al. | |
| 5,982,252 | A | 11/1999 | Werlau | |
| 6,130,588 | A | 10/2000 | Gallivan et al. | |
| 6,150,897 | A | 11/2000 | Nishikawa et al. | |
| 6,285,273 | B1 | 9/2001 | Morikawa | |
| 6,294,965 | B1 | 9/2001 | Merrill et al. | |
| 6,750,752 | B2 | 6/2004 | Werlau | |
| 6,914,512 | B2 | 7/2005 | Park et al. | |
| 6,982,609 | B1 | 1/2006 | McKay et al. | |
| 7,068,122 | B2 | 6/2006 | Weng et al. | |
| 7,274,267 | B2 | 9/2007 | Saitou et al. | |
| 7,692,512 | B2 | 4/2010 | Podell | |

(Continued)

OTHER PUBLICATIONS

Mutual Inductance; http://www.electronics-tutorials.ws; Oct. 11, 2009.*

(Continued)

*Primary Examiner* — Benny Lee
*Assistant Examiner* — Rakesh Patel
(74) *Attorney, Agent, or Firm* — Kolisch Hartwell, P.C.

(57) ABSTRACT

A balun comprising first and second transmission lines having a shared intermediate conductor. The first transmission line may include first and second conductors. The first conductor may have a first end for conducting an unbalanced signal relative to a circuit ground and a second end for conducting a balanced signal. The second conductor may have first and second ends proximate the respective first and second ends of the first conductor. The first and second ends of the second conductor may be open-circuited. The second transmission line may include the second conductor and a third conductor having a first end connected to circuit ground and a second end for conducting the balanced signal. The second conductor may surround the first and third conductors, and one or more ferrite sleeves may surround the second conductor.

10 Claims, 3 Drawing Sheets

(56) References Cited

U.S. PATENT DOCUMENTS

| | | | | |
|---|---|---|---|---|
| 7,839,232 | B2 | 11/2010 | London | |
| 8,248,180 | B2 | 8/2012 | Podell | |
| 2010/0301963 | A1* | 12/2010 | Podell | 333/26 |
| 2011/0074519 | A1 | 3/2011 | Powell | |

OTHER PUBLICATIONS

Monteath, G.D., "Coupled Transmission Lines as Symmetrical Directional Couplers", Proc. IEE, May 1955, vol. 102, Part B, No. 3, pp. 383-392.

Gerst, C.W., "Electrically Short 90° Couplers Utilizing Lumped Capacitors", Microwave Symposium Digest, G-MTT International, May 1967, vol. 67, Issue 1, pp. 58-62.

Russell, Kenneth J., "Microwave Power Combining Techniques", IEEE Transactions on Microwave Theory and Techniques, May 1979, vol. MTT-27, No. 5, pp. 472-478.

Illingworth, Valerie (editor), Definition of the word "balun", The Penguin Dictionary of Electronics, Second Edition, Copyright 1988, p. 30, Penguin Books.

Horowitz et al., "Stubs, baluns, and transformers", The Art of Electronics, Second Edition, Copyright 1989, Section 13.10, pp. 881-882, Cambridge University Press.

Rogers Corporation, "RT/duroid 5870/5880 High Frequency Laminates" data sheet, Copyright 1989-2006 Rogers Corporation (Revised Nov. 2006), 2 pages.

An et al., "A 50:1 Bandwidth Cost-Effective Coupler with Sliced Coaxial Cable", IEEE MTT-S Digest, 1996, 4 pages.

Alexanian, Angelos, "Planar and Distributed Spatial Power Combiners" doctoral dissertation, University of California Santa Barbara, Jun. 1997, 119 pages.

Cheng et al., "A 120-W X-Band Spatially Combined Solid-State Amplifier", IEEE Transactions on Microwave Theory and Techniques, Dec. 1999, vol. 47, No. 12, pp. 2557-2561.

Kim et al., "Ultra-wideband uniplanar MMIC balun using field transformations", Electronics Letters, Mar. 16, 2006, vol. 42, No. 6, 2 pages.

Microwave Encyclopedia—microwaves101.com, "Baluns", downloaded from http://www.microwaves101.com/encyclopedia/baluns.cfm, updated Nov. 26, 2006 and downloaded Aug. 1, 2007, 4 pages.

The Southgate Amateur Radio Club, "Techtip: Coax Balun by G8MNY", downloaded from www.southgatearc.org on Aug. 3, 2007, 2 pages.

* cited by examiner

BALUN WITH INTERMEDIATE NON-TERMINATED CONDUCTOR

BACKGROUND

This disclosure relates to baluns for converting between balanced signals and unbalanced signals. More specifically, it relates to baluns having an intermediate conductor that is not terminated.

For certain applications, there is a need for a broadband, high power communication system. For example, in military applications a broad bandwidth is required for secure spread spectrum communication and high power is required for long range. High power broadband communication systems require high power broadband antennas. Often these antennas have an input impedance that does not match the desired transmitter or receiver with which it is used. In such circumstances, baluns can be used to transform the impedance of the antenna to the impedance of the transmitter or receiver, or to convert between an unbalanced signal and a balanced signal. When large bandwidths are desired, coaxial baluns are often used.

Simple signal sources have two terminals, a source terminal and a return terminal, where most commonly a ground plane is used for the return path. The ground plane return simplifies circuit wiring, as a single conductor and the ground plane below form a complete signal path. The voltage on the ground plane is then the reference for this signal. Often this is referred to as an "unbalanced circuit", or "single-ended circuit". In such "unbalanced circuits" when wires cross or run parallel with one another, there can be undesired coupling.

One method for reducing such coupling is to use two wires, one carrying the signal, the other carrying the return signal, with no ground plane return path. With AC signals, either wire can be considered to carry the signal, and the other to carry the return signal. To minimize coupling to other circuits, it is highly desired that the signal current flowing in the two wires be exactly the same, and 180-degrees out of phase. That is, all of the return current for one wire of the pair is carried by the other wire, and the circuit is balanced. This guarantees that no return current is carried by the ground plane. In practice, such perfectly balanced, or differential, currents are only a theoretical goal.

An amplifier that uses balanced or differential input and output connections is less likely to have oscillations caused by input and output signals coupling, and less extraneous noise introduced by the surrounding circuitry. For this reason, practically all high gain operational amplifiers are differential. A "balun" is a coupling device that converts an unbalanced source to a balanced one, and vice versa. Sometimes a balun is made with nearly complete isolation between the balanced terminals and ground. Sometimes a balun is made with each balanced terminal referenced to ground, but with equal and opposite voltages appearing at these terminals. These are both types of baluns, but in one case, the unbalanced voltage encounters high impedance to ground, making unbalanced current flow difficult, while in the other, any unbalanced current encounters a short circuit to ground, minimizing the voltage that enters the balanced circuit. Microwave baluns can be either of these types, or even a mixture of the two. In any case, one could connect two equal unbalanced loads to the two balanced terminals, with their ground terminals connected together to ground. Ideally, the unbalanced signal input to the balun would be equally distributed to the two unbalanced loads. Thus, a balun may be used as a power divider or combiner, where the two unbalanced loads or sources connected to the balanced terminals would be operating 180-degrees out of phase.

At microwave frequencies, it is very difficult to fabricate well balanced circuits, as small parasitic elements can unbalance the signals. A well balanced power divider or combiner that operates over a wide microwave bandwidth is thus a very important component, and one that supplies differential, 180-degree out-of-phase outputs is desirable because of its independence from currents flowing in the ground plane.

BRIEF SUMMARY

In one example, a balun may include first and second transmission lines having one conductor that is shared by both transmission lines. The first transmission line may include a first conductor and a second conductor. The first conductor may have a first end for conducting an unbalanced signal relative to a circuit ground and a second end for conducting a balanced signal. The second conductor may have first and second ends. The first end of the second conductor may be proximate to the first end of the first conductor. The first and second ends of the second conductor also may both be open-circuited (unconnected to the first conductor and/or unconnected to the circuit ground). The second end of the second conductor may be proximate to the second end of the first conductor. The second transmission line may include the second conductor and a third conductor. The third conductor may have a first end proximate to the first end of the second conductor and connected to the circuit ground, and a second end for conducting the balanced signal. The second conductor may surround the first and second conductors, and a ferrite sleeve may surround the second conductor.

In some examples, the second conductor may include at least first and second spaced-apart conductor segments extending serially between the first and second ends of the second conductor. Each conductor segment may have first and second ends and be inductively coupled to the first and third conductors. The first end of each conductor segment may be closer to the first end of the first conductor than the second end of the first conductor. The first and second ends of each conductor segment may both be open-circuited. The second end of each conductor segment may be closer to the second end of the first conductor than the first end of the first conductor. The first end of the first conductor segment may be the first end of the second conductor and the second end of the second conductor segment may be the second end of the second conductor. The first and second conductor segments may surround one or both of the first and second conductors, and one or more ferrite sleeves may surround one or both of the conductor segments.

In some examples, a balun may include first, second and third conductors. The first conductor may have a continuous length between a first end for conducting a signal relative to a circuit ground and a second end for conducting a balanced signal with a first polarity. The second conductor may be inductively coupled to the first conductor substantially along the length of the first conductor, and have first and second ends. The first end of the second conductor may be disposed proximate to the first end of the first conductor. The second end of the second conductor may be proximate to the second end of the first conductor. The first and second ends of the second conductor may be open-circuited. A third conductor may have a continuous length extending between a first end proximate to the first end of the second conductor and a second end proximate to the second end of the second conductor. The first end of the third conductor may be connected to the circuit ground. The second end of the third conductor may be for conducting the balanced signal with a second polarity opposite the first polarity. The second conductor may be inductively coupled to the third conductor substantially along the length of the third conductor.

DETAILED DESCRIPTION

Figure 1:
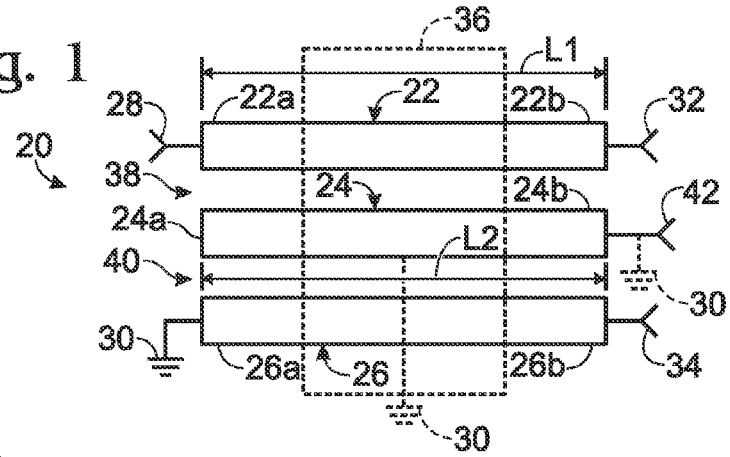
FIG. 1 is a general diagram showing a three-conductor balun.

Referring initially to FIG. 1, a basic balun 20 may include a first conductor 22, a second conductor 24, and a third conductor 26. First conductor 22 has a first end 22*a* and a second end 22*b*. Similarly, second conductor 24 has a first end 24*a* and a second end 24*b*, and third conductor 26 has a first end 26*a* and a second end 26*b*. An unbalanced or single-ended signal is input or output on, and therefore conducted by, first end 22*a* of first conductor 22, represented by a port 28. The return signal is conducted on a circuit ground 30 connected to first end 26*a* of third conductor 26.

The opposite, second ends 22*b* and 26*b* of the first and third conductors 22 and 26, represented by respective ports 32 and 34, output or input (conduct) a balanced signal. Ports 32 and 34 also may conduct single-ended signals relative to circuit ground 30. Reference to "balanced" signals, ports or conductors will be understood to also refer to signals or the conducting of signals of equal amplitude and opposite polarity, and may include dual balanced single-ended signals. Ports or terminals are simply locations on the circuit where the characteristics of the circuit may be determined or observed, practically or theoretically, and do not necessarily represent structure where external circuits are connected.

In this example, the first end 24*a* of second conductor 24 is open-circuited. That is, it is not directly electrically connected to any electrically conductive component, such as circuit ground 30, or first or third conductors 22 and 26, as shown. Similarly, the second end 24*b* of the second conductor 24 is open-circuited. A ferrite sleeve 36 may surround an intermediate portion of the three conductors. In examples in which intermediate conductor 24 substantially surrounds conductors 22 and 26, such as coaxial or strip-line examples, ferrite sleeve 36 may choke any voltage to ground induced on conductor 24.

In the conductor configuration shown in FIG. 1, the first conductor is inductively coupled to the second conductor substantially along the length L1 of the first conductor, and the third conductor is inductively coupled to the second conductor substantially along the length L2 of the third conductor. The lengths L1 and L2 may be of a suitable electrical length, and are often an odd number of quarter wavelengths at a frequency of use although this is not necessary. The first and second conductors 22 and 24 may form a first transmission line 38, and the second and third conductors 24 and 26 may form a second transmission line 40. Transmission lines 38 and 40, sharing a common conductor 24 and having the configuration shown may be of any suitable form or structure that converts between a balanced signal and an unbalanced signal. For example, balun 20 may be formed of strip conductors that are coplanar, parallel-plane, or other three-dimensional configuration. Various coaxial variations may be envisioned. For example, the second conductor may continuously or partially surround, such as be concentric around, the first (or third) conductor and the third (or first) conductor may surround the second conductor. The second conductor may surround the first and third conductors separately or jointly.

Balun 20 may be used as an impedance transformer between signal source(s) and load(s). The impedances of the balanced and unbalanced signals may be the same or they may be different. The impedances of transmission lines 38 and 40 may have respective selected impedances that provide appropriate impedances at the unbalanced-signal port and across the balanced signal ports. The balun may have an impedance at the unbalanced-signal port 28 that corresponds with the impedance of a circuit or transmission line attached to the balun at port 28. The impedances of the first and second transmission lines will appear to be in series between port 28 and circuit ground, so the combined impedances of the two transmission lines may be configured to correspond to the impedance of the external circuits or lines as well as any differences between the impedances of the balanced and unbalanced-signal lines and circuits.

In one example, the balanced and unbalanced signal lines may both be 50 ohms as is common in commercial circuits. If transmission lines 38 and 40 both have individual impedances of 25-ohms, then the input and output impedances of the balun will provide reasonable match with the impedances of the external lines. Different impedances may also be used.

Balun 20 may also function as a sum-difference hybrid coupler, such as a magic-T coupler. In that example, unbalanced-signal port 28 is the difference port and balanced-signal ports 32 and 34 are the input or output ports and have signals that are 180-degrees out of phase. Second end 24*b* of conductor 24 could form a fourth, sum port 42 that if used as a sum port may be terminated through a resistor to ground, not shown. When not used as a port it may be left unterminated, as shown. Alternatively, conductor 24 may be terminated anywhere along its length, as shown by the exemplary terminations in dashed lines at an intermediate position and at end 24*b*, to modify balance and frequency response at ports 32 and 34. The termination of port 42 to ground also may be used to provide a low thermal impedance path to ground for balun 20, which may increase the power-carrying capability of the circuit.

This balun may function as a sum-difference hybrid coupler with the sum port 42 terminated. In a sum-difference hybrid coupler, a signal input at the difference port 28 is divided equally between two output ports (the balanced signal ports 32 and 34 in this case) with one signal being 180-degrees out of phase from the other. The terminated sum port is isolated from the difference port and ideally does not conduct any portion of the balanced signal.

It will thus be apparent that a balun may comprise first and second transmission lines. In this example, the first transmission line may include a first conductor and a second conductor, with the first conductor having a first end for conducting a signal relative to a circuit ground and a second end for conducting a balanced signal, the second conductor having first and second ends that are open-circuited. The first end of the second conductor is disposed closer to the first end of the first conductor than the second end of the first conductor, unconnected to the first conductor, and unconnected to the circuit ground. The second end of the second conductor is proximate to the second end of the first conductor. The second transmission line may include the second conductor and a third conductor, the third conductor having a first end proximate to the first end of the second conductor and connected to the circuit ground and a second end for conducting the balanced signal.

In some examples, a balun may include first, second and third conductors. The first conductor may have a continuous length between a first end for conducting a signal relative to a circuit ground and a second end for conducting a balanced signal with a first polarity. The second conductor may be inductively coupled to the first conductor substantially along the length of the first conductor, and have open-circuited first and second ends. A third conductor may have a continuous length extending between a first end proximate to the first end of the second conductor and a second end proximate to the second end of the second conductor. The first end of the third conductor may be connected to the circuit ground. The second end of the third conductor may be for conducting the balanced signal with a second polarity opposite the first polarity. The second conductor may be inductively coupled to the third conductor substantially along the length of the third conductor. A ferrite sleeve may surround the three conductors.

Figure 2:
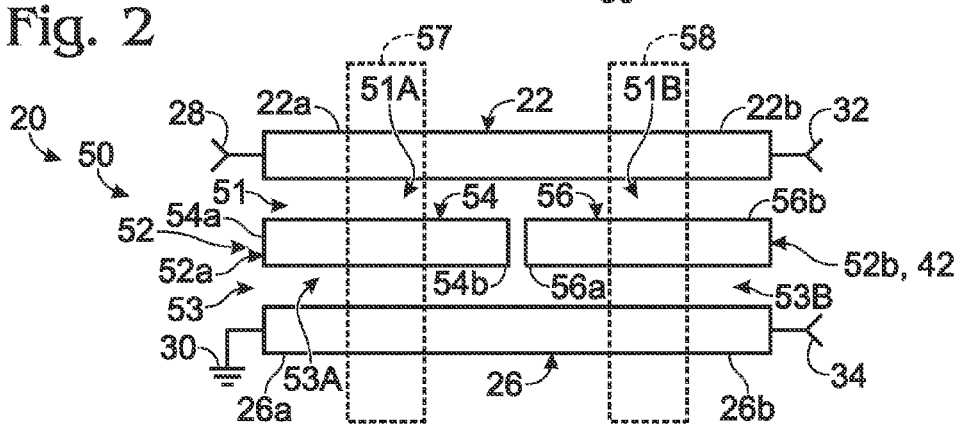
FIG. 2 is a diagram similar to FIG. 1 showing a three-conductor balun with one conductor having two segments.

A further example of a balun 20 is illustrated generally at 50 in FIG. 2. Like parts are given the same numbers as those for balun 20. Hence, balun 50 may include a first transmission line 51 formed by a first conductor 22 and a second conductor 52 and a second transmission line 53 formed by second conductor 52 and a third conductor 26. Conductor 22 has conductor ends 22*a* and 22*b*, conductor 52 has conductor ends 52*a* and 52*b*, and conductor 26 has conductor ends 26*a* and 26*b*. Unbalanced or difference port 28 is at conductor end 22*a*. Balanced signal ports 32 and 34 are at conductor ends 22*b* and 26*b*, respectively. Conductor end 52*b* may be used as a sum port 42. Conductor ends 52*a* and 52*b* may be open-circuited. Conductor end 24*a* may be open circuited, and conductor end 26*a* may be connected to circuit ground 30.

Balun 50 differs from balun 20 in this example in that conductor 52 is a conductor assembly formed of two electrically spaced-apart conductor segments 54 and 56, both inductively coupled to conductors 22 and 26. Conductor segment 54 is proximate to first-conductor end 22*a*, and has a first conductor-segment end 54*a* that corresponds to conductor end 52*a*, is open-circuited, and also is proximate to first-conductor end 22*a*. An opposite second conductor-segment end 54*b* is distal of first conductor end 22*a*, and is also open-circuited. Similarly, conductor segment 56 is proximate to first-conductor end 22*b*, and has a first conductor-segment end 56*a* that is open-circuited and proximate to and spaced from second conductor-segment end 54*b*.

An opposite second conductor-segment end 56*b* is proximate to first conductor end 22*b* and is also open-circuited and corresponds to conductor end 52*b* and sum port 42. Transmission lines 51 and 53 may be considered to have respective first transmission-line segments 51A and 53A associated with conductor segment 54, and second transmission-line segments 51B and 53B associated with conductor segment 56. A first ferrite sleeve 57 may surround transmission line segments 51A and 53A, and a second ferrite sleeve 58 may surround transmission line segments 51B and 53B.

Balun 20, as with baluns generally, functions well when conductors 22, 52, and 26 are one-quarter-wavelength long. However, when the signal has a frequency for which the balun conductors are one-half wavelength long, the short to ground on conductor end 26*a* appears as a short across one of output ports 32 and 34, eliminating the balance in the balanced-signal output. By dividing conductor 52 lengthwise into two conductor segments 54 and 56, balun 50 functions like balun 20 but may operate over a greater bandwidth with the two conductor segments being ¼-wavelength long when conductors 22 and 26 are ½-wavelength long.

Since the second conductor 52 is disposed between the first and third conductors 22 and 26 and is not connected to anything (is open-circuited at both ends), the impedance between the first and third conductors at the unbalanced signal end is the sum of the impedances of the first and second transmission lines 51 and 53. The impedances of these transmission lines may be set to add up to about the impedance of the unbalanced line, which is 50 ohms in this example. Ideally, the second conductor 24 follows an equipotential line between conductors 22 and 26. However, there is a voltage drop along the third conductor 26 from the grounded end 26*a* to the balanced output terminal.

Under balanced conditions and for equal unbalanced and balanced signal voltages, the voltage to ground at the balanced ports 32 and 34 is one-half the unbalanced input voltage. Half way down third conductor 26 the voltage is about one-fourth of the unbalanced-signal input voltage. At that point, the voltage on the "hot" first conductor 22 is about three-fourths of the input voltage. For example, if the transmission-line segment 53A has an impedance of 12.5-ohms and transmission-line segment 51A has an impedance of 37.5-ohms along first conductor segment 52, then the voltage at the midway point of the balun at conductor-segment end 54*b* will be essentially zero. Similarly, if the impedances on transmission line segments 51B and 53B are both 25 ohms and the loads on balanced ports 32 and 34 are equal, then ideally there is no voltage on conductor segment end 56*b* relative to ground. However, any unbalance in the output results in the power being dissipated in the ferrite sleeves 57 and 58. This design may perform well over a bandwidth that may cover a decade or more with good input match, and with about two octaves of good isolation between output ports.

Figure 3:
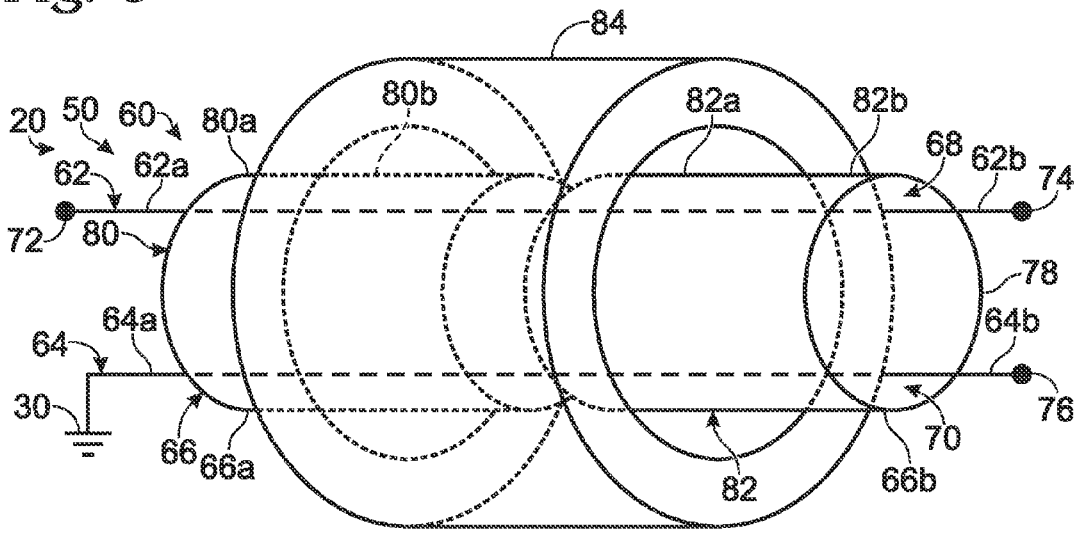
FIG. 3 is a diagram of a dual-center conductor coaxial version of the balun of FIG. 2 with a ferrite sleeve.

FIG. 3 illustrates at 60 a first coaxial embodiment of balun 50. Balun 60 includes two center conductors 62 and 64, and an outer shield conductor 66 radially surrounding and coaxial with both conductors 62 and 64. Conductors 62 and 64 are preferably loosely coupled relatively to each other, but each is relatively tightly coupled to shield conductor 66. A first transmission line 68 is formed by conductors 62 and 66 and a second transmission line 70 formed by conductors 64 and 66. Center conductor 62 has ends 62*a* and 62*b*, center conductor 64 has conductor ends 64*a* and 64*b*, and outer conductor 66 has open-circuited conductor ends 66*a* and 66*b*. An unbalanced-signal or difference port 72 is at center-conductor end 62*a*. Balanced-signal ports 74 and 76 are at center-conductor ends 62*b* and 64*b*, respectively. A sum port 78 is at intermediate-conductor end 66*b*. Center-conductor end 64*a* is connected to circuit ground 30.

As shown, intermediate-conductor 66 is a conductor assembly formed of two electrically distinct or spaced-apart conductor segments 80 and 82, both inductively coupled to conductors 62 and 64. Conductor segment 80 is proximate to center-conductor end 62*a*, and has a first conductor-segment end 80*a* that is open-circuited and also proximate to center-conductor end 62*a*. An open-circuited opposite second conductor-segment end 80*b* is distal of center-conductor end 62*a*. Similarly, conductor segment 82 is proximate to center-conductor end 62*b*, and has a first conductor-segment end 82*a* that is open-circuited and proximate to and spaced from second conductor-segment end 80*b*. An opposite open-circuited second conductor-segment end 82*b* is proximate to center-conductor end 62*b*, and corresponds to sum port 78.

A ferrite sleeve 84 is illustrated that surrounds respective portions of transmission lines 68 and 70 along both of conductor segments 80 and 82. In some examples, a separate ferrite sleeve may surround the transmission line portions associated with each of conductor segments 80 and 82, such as is shown in FIG. 2. In some examples, a single ferrite sleeve surrounding a portion of the transmission lines associated with one of the conductor segments 80 and 82 may be used.

The general discussion above with regard to baluns 20 and 50 illustrated in FIGS. 1 and 2 apply to balun 60 as well. Further, since intermediate outer conductor 66 is tightly coupled to each of center conductors 62 and 64, center conductor 62 is substantially isolated from center conductor 64. This enhances the effect of the segmented intermediate conductor.

Figure 4:
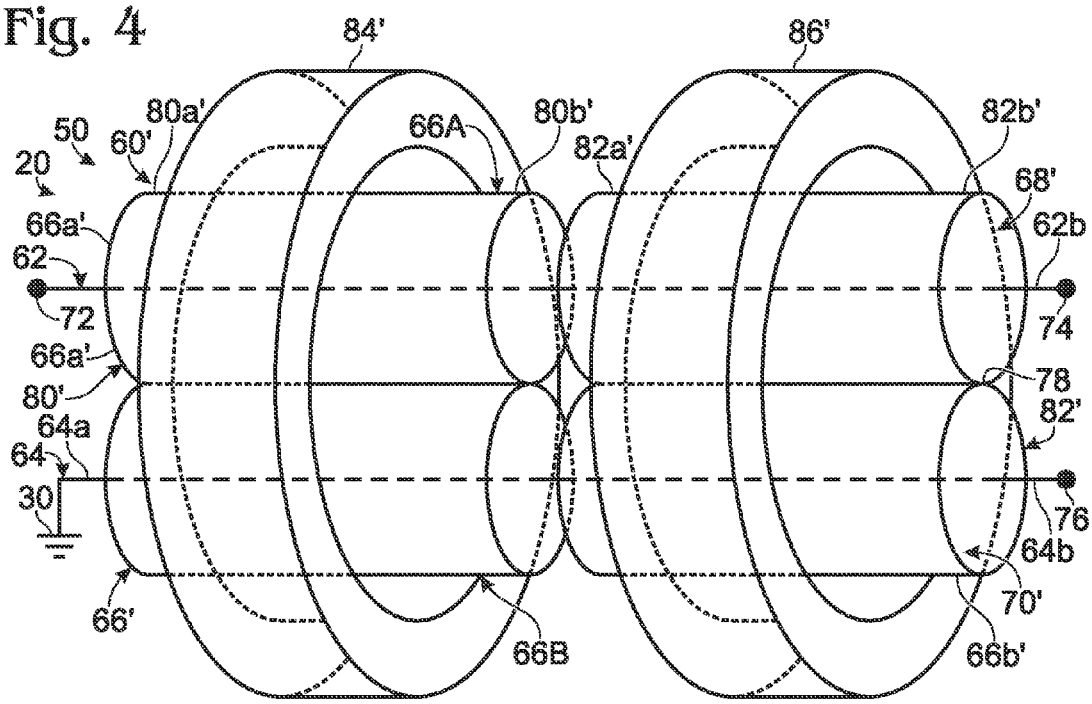
FIG. 4 is a diagram of a dual-coaxial version of the balun of FIG. 2 with a ferrite sleeve on each of two segments of a shield conductor.

FIG. 4 illustrates a second example of a coaxial embodiment of baluns 20 and 50. Corresponding elements have the same reference numbers as those for balun 60 in FIG. 3 for ease of illustration. A balun 60' includes two center conductors 62 and 64, and an outer shield conductor 66' formed by attached outer shield conductors 66A and 66B that are attached along their lengths. Outer shield conductor 66A radially surrounds and is coaxial with inner conductor 62, and outer shield conductor 66B radially surrounds and is coaxial with inner conductor 64. Conductors 62 and 64 are electrically isolated from each other by outer shield conductor 66'. A first transmission line 68' is formed by conductors 62 and 66A and a second transmission line 70' is formed by conductors 64 and 66B. Center conductor 62 has ends 62*a* and 62*b*, center conductor 64 has conductor ends 64*a* and 64*b*, and outer conductor 66' has open-circuited conductor ends 66*a*' and 66*b*'. An unbalanced-signal or difference port 72 is at center-conductor end 62*a*. Balanced-signal ports 74 and 76 are at center-conductor ends 62*b* and 64*b*, respectively. A sum port 78 is at intermediate-conductor end 66*b*'. Center-conductor end 64*a* is connected to circuit ground 30.

As shown, intermediate-conductor 66' is a conductor assembly formed of two electrically distinct or spaced-apart conductor segments 80' and 82', both inductively coupled to conductors 62 and 64. Conductor segment 80' is proximate to center-conductor ends 62*a* and 64*a*, and has a first conductor-segment end 80*a*' that is open-circuited and also proximate to center-conductor end 62*a*. An open-circuited opposite second conductor-segment end 80*b*' is distal of center-conductor end 62*a*. Similarly, conductor segment 82' is proximate to center-conductor end 62*b*, and has a first conductor-segment end 82*a*' that is open-circuited and proximate to and spaced from second conductor-segment end 80*b*'. An opposite open-circuited second conductor-segment end 82*b*' is proximate to center-conductor end 62*b*, and corresponds to sum port 78.

In this example, a ferrite sleeve 84' surrounds a portion of transmission lines 68 and 70 associated with conductor segment 80', and a ferrite sleeve 86' surrounds a portion of transmission lines 68' and 70' associated with conductor segment 82'. In some examples, a single ferrite sleeve bay be used in balun 60', or a single ferrite sleeve surrounding portions of the transmission lines associated with both of the conductor segments 80' and 82' may be used.

The general discussion above with regard to baluns 20 and 50 illustrated in FIGS. 1 and 2 apply to balun 60' as well.

It will therefore be appreciated from the foregoing that an example has been provided of a balun that includes an intermediate conductor 66 or 66' with at least first and second spaced-apart conductor segments 80 or 80' and 82 or 82' extending serially between the first and second ends of the intermediate conductor 66 or 66', with each conductor segment having first and second ends that may be open-circuited and being inductively coupled to the first and third conductors. The first end of each conductor segment may be closer to the first end of the first conductor than the second end of the first conductor. The second end of each conductor segment may be closer to the second end of the first conductor than the first end of the first conductor. The first end of the first conductor segment may be adjacent to the first end of the second conductor and the second end of the second conductor segment may be adjacent to the second end of the second conductor. The balun may further include one or more ferrite sleeves surrounding the outer conductor.

The intermediate conductor shown in the figures may provide a means to adjust the voltage on the outer conductor of the transmission line system. In examples where conductor 24 essentially encloses conductor 22 and conductor 26, as shown in FIGS. 3 and 4, forming a dual coaxial transmission line system, the impedance from conductor 22 to 26 may then be the sum of the impedances of the two separate coaxial transmission lines. For a non-impedance transforming balun, the ratios of the impedances of coaxial transmission lines 51 and 53 may be related by a ratio chosen to reduce the voltage to ground on the intermediate conductor.

However, there is another transmission path along the outer conductors as represented by conductor 24. This propagation path can be choked off with a ferrite sleeve, such as sleeve 84 shown in FIG. 3. A voltage to ground of this conductor may be reduced to keep the resistance along this outer conductor high at high frequencies. At the balanced end of the system the voltages may be equal and opposite.

At this position, equal impedance coaxial transmission lines may ideally cause the common shield to have zero voltage on it. At positions towards the unbalanced input, the voltages on the center conductors are more unbalanced. The impedances of the coaxial transmission lines may be adjusted in a way that will tend to cause the common outer conductor to have zero voltage in this region or as close to zero voltage as can reasonably be achieved. The sum of the impedances of the two coaxial transmission lines should be about 50 ohms in a 50-ohm transmission line system.

For example, assuming an unbalanced input voltage of V, then half way towards the unbalanced input the two center conductors, such as center conductors 62 and 64 shown in FIG. 4, may have a voltage of 3V/4 and −V/4. These voltages may be achieved when the two line impedances may be set to have a selected ratio, such as three-to-one. For a 50-ohm system, the respective impedances of 37.5 ohms and 12.5 ohms may be used to produce a shield voltage of zero volts at the mid-point. Under this condition, the shield voltage at the unbalanced end may be V/4, and the voltage at the balanced end of the shield may be −V/4. For a single shielded section balun, as represented by the balun of FIG. 1, this would have good high frequency loss performance, as the maximum voltage is half that of the simple design with a shield grounded at the input, and also half that of the three wire design with equal 25 ohm lines where the shield is at zero volts to ground at the balanced end.

By using multiple segments of shielded pairs whose impedance sums to 50 ohms, each segment may have an impedance ratio selected to produce zero volts to ground on the common shield. This may reduce the high frequency loss compared to a single shielded section balun. For frequencies below 2-GHz, about half inch segments provide good performance, and one inch segments have poorer performance.

Hence, a segment length of less than one inch is found to be desirable for these frequencies.

Figure 5:
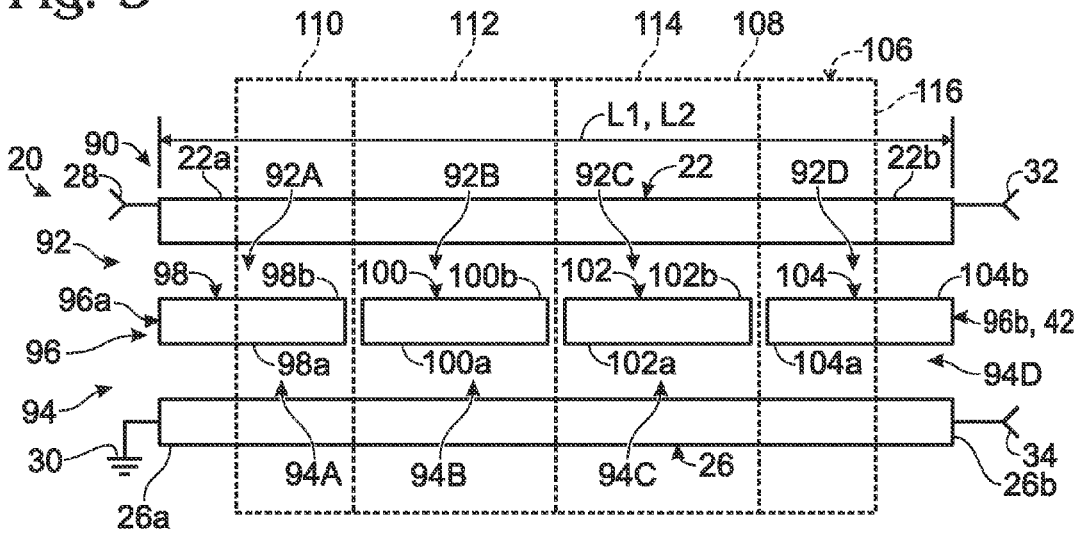
FIG. 5 is a diagram similar to FIG. 2 showing a three-conductor balun with one conductor having four segments.

A further example of baluns 20 and 50 is illustrated generally at 90 in FIG. 5. Like parts are given the same numbers as those for balun 20. Balun 90 includes first and second transmission lines 92 and 94. First transmission line 92 may be formed by a first conductor 22 and a second conductor 96. Second transmission line 94 may be formed by second conductor 96 and a third conductor 26. Conductor 22 has conductor ends 22*a* and 22*b*, conductor 96 has conductor ends 96*a* and 96*b*, and conductor 26 has conductor ends 26*a* and 26*b*. Unbalanced or difference port 28 is at conductor end 22*a*. Balanced signal ports 32 and 34 are at conductor ends 22*b* and 26*b*, respectively. Sum port 42 is at conductor end 96*b*. Conductor ends 96*a* and 96*b* are open-circuited, and conductor end 26*a* is connected to circuit ground 30.

Balun 90 differs from balun 20 in that conductor 96 is a conductor assembly formed of four electrically distinct or spaced-apart conductor segments 98, 100, 102, and 104, all inductively coupled to conductor 22 along length L1 and inductively coupled to conductor 26 along length L2. Lengths L1 and L2 are equal in this example. Conductor segments 98, 100, 102, and 104 extend progressively along conductor 22 from conductor end 22*a* to conductor end 22*b*. Each conductor segment has a first conductor-segment end, such as ends 98*a*, 100*a*, 102*a* and 104*a*, that is proximate to first-conductor end 22*a* and that is open-circuited. An opposite second conductor-segment end of each conductor segment, such as conductor-segment ends 98*b*, 100*b*, 102*b*, and 104*b*, is distal of first conductor end 22*a*, and is also open-circuited. Second-conductor-segment end 104*b* of conductor segment 104 corresponds to sum port 42, or may be left open circuited, or grounded, if convenient to do so.

Transmission lines 92 and 94 have respective transmission-line segments 92A and 94A associated with conductor segment 98, transmission-line segments 92B and 94B associated with conductor segment 100, transmission-line segments 92C and 94C associated with conductor segment 102, transmission-line segments 92D and 94D associated with conductor segment 104.

A ferrite sleeve assembly 106 may include a single ferrite sleeve 108 extending along respective portions of transmission lines 92 and 94. Ferrite sleeve assembly 106 may also include a plurality of ferrite sleeves, such as, for example, ferrite sleeve 110 surrounding a portion of transmission-line segments 92A and 94A, ferrite sleeve 112 surrounding a portion of transmission-line segments 92B and 94B, ferrite sleeve 114 surrounding a portion of transmission-line segments 92C and 94C, and ferrite sleeve 116 surrounding a portion of transmission-line segments 92D and 94D.

The impedance values of the transmission-line segments are selected as appropriate for the particular application. That is, the impedances of the transmission-line segments are selected to transition the impedances between unbalanced-signal port 28 and balanced-signal ports 32 and 34.

The sum of the impedances of the transmission-line segments 92A and 94A may be set to correspond with the impedance at unbalanced port 28. Similarly, where the balanced signal ports 32 and 34 are connected to or designed to be connected to a balanced signal, the impedances of the transmission-line segments 92D and 94D are set to correspond to the impedances of the balanced signal on ports 32 and 34. Where the balanced signal ports 32 and 34 are connected to or designed to be connected to respective unbalanced or single-ended signals, the sum of the impedances of transmission-line segments 92D and 94D may be set to correspond to the respective impedances of the two balanced signals on ports 32 and 34.

Correspondingly, the impedances of the intermediate transmission-line segments 92B, 92C, 94B, and 94C are set to progressively transition the respective impedances between the unbalanced-port end and the balanced-port end. The table below gives representative impedances for the transmission-line segments that provide progressively transitioning impedances that produce reduced or minimal voltage at conductor segment ends 98*b*, 100*b*, 102*b*, and 104*b*. The first example provides matching between a single 50-ohm unbalanced signal and a 50-ohm balanced signal or two 25-ohm single-ended signals. The second example provides matching between a single 50-ohm unbalanced signal and a 100-ohm balanced signal or two 50-ohm unbalanced signals.

Table of Representative Impedance Values, Ohms

| | Seg. A | Seg. B | Seg. C | Seg. D |
|---|---|---|---|---|
| Example 1: 50-ohm unbalanced to 50-ohm balanced (25-ohm single-ended) | | | | |
| Line 92 | 39 | 30.2 | 25.6 | 25 |
| Line 94 | 8.4 | 17.5 | 19.8 | 25 |
| Example 2: 50-ohm unbalanced to 100-ohm balanced (50-ohm single-ended) | | | | |
| Line 92 | 44.4 | 41.3 | 40.16 | 40.1 |
| Line 94 | 10 | 20.3 | 31 | 47.7 |

It is seen that the impedances for each transmission line vary progressively between the first and second ends of the first and third conductors and have values generally about or between the impedances of the circuits to which they are attached. For example, the balun of Example 1 is for connecting a 50-ohm unbalanced circuit to a 50-ohm balanced circuit. The impedances of the transmission-line segments in transmission line 92 vary between 50-ohms, the unbalanced-signal circuit impedance, and 25-ohms, one-half the balanced-signal circuit impedance. Similarly, the impedances of the transmission-line segments in transmission line 94 vary between O-ohms, the impedance to ground on conductor end 26*a*, and 25-ohms, one-half the balanced-signal circuit impedance.

Figure 6:
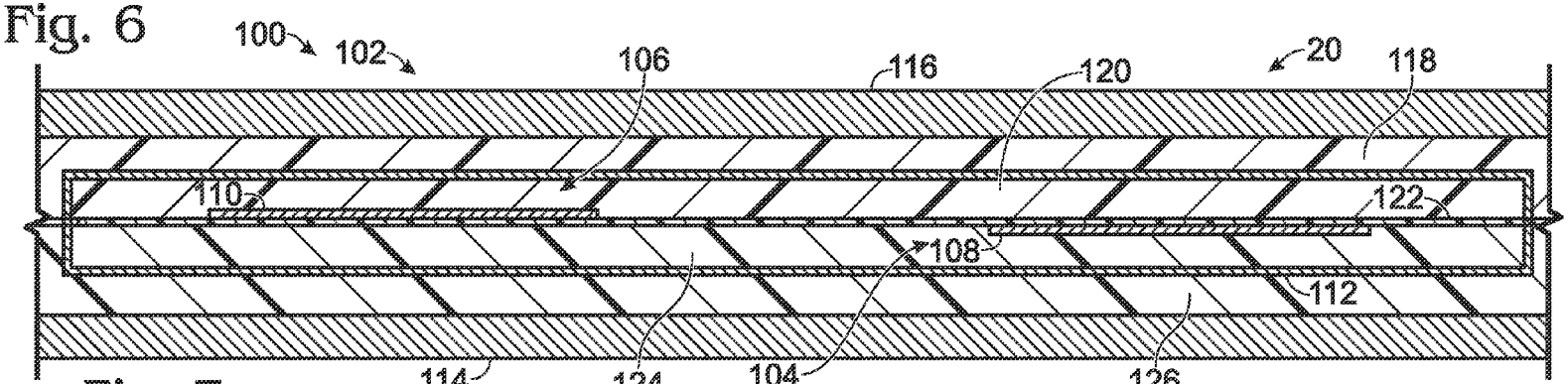
FIG. 6 is a transverse cross section of a strip-line version of a balun according to FIG. 1, FIG. 2, or FIG. 4.

FIG. 6 illustrates a cross-section of a balun 100 as an example of a balun 20 or balun 90. In this example, balun 100 includes a multi-layered printed circuit-board (PCB) assembly 102 containing transmission lines 104 and 106. Inner conductors 108 and 110 are each respectively closely coupled to an outer conductor 112 that surrounds both of conductors 108 and 110, as shown. Similar to conductor 66 of balun 60, outer conductor 112 is divided longitudinally into spaced-apart conductor segments, not shown. Each conductor segment surrounds respective portions of inner conductors 108 and 110 in a rectangular, generally coaxial configuration, with the common axis extending normal to the view of FIG. 6.

The bottom face of PCB assembly 102 is similarly covered with a first ferrite layer 114 and the top face is covered with a second ferrite layer 116.

As shown in FIG. 6, PCB assembly 102 further includes a first outer dielectric layer 118 separating upper ferrite layer 116 from outer conductor 112. A first intermediate layer 120 separates outer conductor 112 from inner conductor 110. A central dielectric layer 122 extends between the planes of inner conductors 108 and 110. A second intermediate dielectric layer 124 separates inner conductor 108 from outer conductor 112. A second outer dielectric layer 126 separates outer conductor 112 from lower ferrite layer 114.

The vertical dimension in FIG. 6 is expanded for clarification of illustration. As mentioned, center conductors 108 and 110 are tightly coupled to outer conductor 112 to form respective transmission lines 104 and 106, and they are loosely coupled relative to each other. The shape and position of conductors 108 and 110 within outer conductor 112, as well as the characteristics and dimensions of the dielectric layers are designed to provide the appropriate impedances. The dielectric layers may be made of any suitable dielectric, such as RT/Duroid® 5880 made by Rogers Corporation of Chandler, Ariz., U.S.A., and have a thickness selected to provide a desired amount of coupling. The conductors and conductive layers may be made of a suitable conductor, such as 1-oz. copper.

In some applications, the impedances of the transmission-line segments may not readily be provided by varying the dimensions of the traces forming conductors 108 or 110, within manufacturing tolerances. Further adjustment in impedances may be achieved by varying the effective spacing or coupling between segmented conductor 112 and conductors 108 and 110. For example, the impedances may be reduced by extending associated segments of the outer conductor into closer proximity to an inner conductor.

Figure 7:
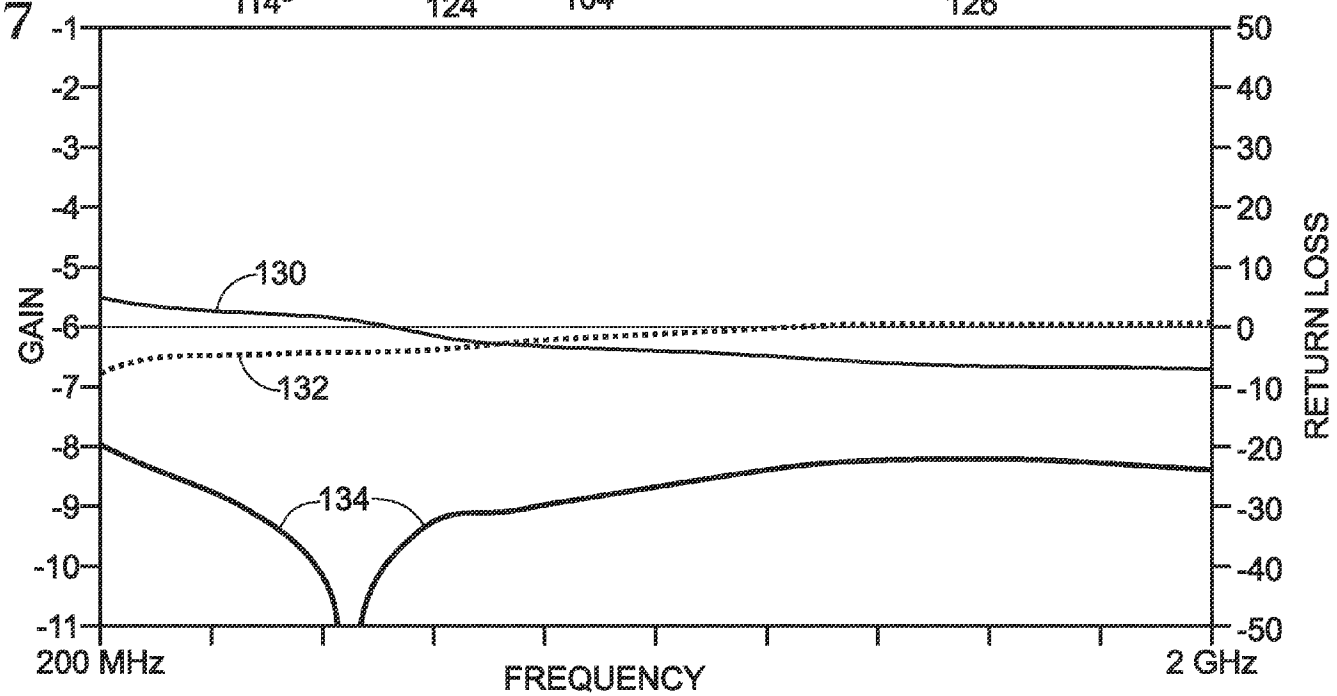
FIG. 7 is chart illustrating operating characteristics of an embodiment of the balun assembly of FIG. 5.

FIG. 7 is a plot of selected performance parameters over a frequency band of 0.2-GHz to 2-GHz of an embodiment of balun assembly 90 illustrated in FIG. 5 and having the impedances listed in the first example of the impedance table. 25-ohm output ports 32 and 34 are each connected to two 50-ohm lines, thereby splitting the power on each of ports 32 and 34 in half. Line 130 represents the gain on one of the 50-ohm lines attached to port 32 for a signal applied on port 28. Similarly line 132 represents the gain on one of the 50-ohm lines attached to port 34 for a signal applied on port 28. It is seen that the gain is close to −6-dB, which corresponds to half of the gain of about −3-dB on each of ports 32 and 34. The reflection coefficient at port 28 represented by line 134 is seen to be below about 20-dB.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled. Accordingly, while embodiments of baluns, couplers, and combiner/dividers have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to telecommunications, signal processing systems, and other applications in which radio-frequency devices and circuits are used.

The invention claimed is:

1. A balun comprising:

a planar first transmission line including a planar first conductor having opposite first and second major faces and a second conductor, the first conductor having a first end for conducting a signal relative to a circuit ground and a second end for conducting a balanced signal, the second conductor having first and second ends, the first end of the second conductor being open-circuited and disposed proximate to the first end of the first conductor, the second end of the second conductor being open-circuited and proximate to the second end of the first conductor;

a planar second transmission line including the second conductor and a planar third conductor extending in a plane parallel to a plane of the first conductor and having opposite first and second major faces, the third conductor being spaced from the first conductor, and having a first end proximate to the first end of the second conductor and connected to the circuit ground and a second end for conducting the balanced signal;

a planar first ferrite layer spaced from the first and third conductors and extending continuously from opposite to the first major face of the first conductor to opposite to the first major face of the third conductor in a first plane parallel to the planes of the first and third conductors; and a planar second ferrite layer spaced from the first and third conductors and extending continuously from opposite to the second major face of the first conductor to opposite to the second major face of the third conductor in a second plane parallel to the planes of the first and third conductors, the first and third conductors being disposed between the first and second ferrite layers;

the second conductor being spaced from the first and third conductors and spaced from the first and second ferrite layers, the second conductor including planar first and second conductor layers, the first conductor layer extending opposite and along the first major faces of the first and third conductors in a third plane parallel to the planes of the first and third conductors and disposed between the first ferrite layer and the first and third conductors, and the second conductor layer extending opposite and along the second major faces of the first and third conductors in a fourth plane parallel to the planes of the first and third conductors and disposed between the second ferrite layer and the first and third conductors, the second conductor also including portions extending between the first and second conductor layers spaced from the first and third conductors.

2. The balun of claim 1, wherein the second conductor includes at least first and second spaced-apart conductor segments extending serially between the first and second ends of the second conductor, with each conductor segment including respective segments of the first and second conductor layers, having first and second ends and being inductively coupled to the first and third conductors, with the first end of each conductor segment being closer to the first end of the first conductor than the second end of the first conductor and being open-circuited; and the second end of each conductor segment being closer to the second end of the first conductor than the first end of the first conductor and being open-circuited, the first end of the first conductor segment being the first end of the second conductor and the second end of the second conductor segment being the second end of the second conductor.

3. The balun of claim 2, wherein each conductor segment surrounds a corresponding portion of the first conductor.

4. The balun of claim 3, wherein each conductor segment also surrounds a corresponding portion of the third conductor.

5. The balun of claim 4, wherein the first and third conductors are respectively coupled closely to the second conductor and the first conductor is loosely coupled to the third conductor.

6. The balun of claim 4, wherein the at least first and second conductor segments each form a shield conductor segment surrounding both the first and third conductors, with the first and third conductors forming dual center conductors.

7. A balun comprising:

a planar first conductor having opposite first and second major faces and a continuous length between a first end for conducting a signal relative to a circuit ground and a second end for conducting a balanced signal with a first polarity, a second conductor inductively coupled to the first conductor substantially along the length of the first conductor, and having first and second ends, the first end of the second conductor being open-circuited and disposed proximate to the first end of the first conductor, the second end of the second conductor being open-circuited and proximate to the second end of the first conductor;

a planar third conductor extending in a plane parallel to a plane of the first conductor, having opposite first and second major faces, and having a continuous length extending between a first end proximate to the first end of the second conductor and a second end proximate to the second end of the second conductor, the first end of the third conductor connected to the circuit ground, the second end of the third conductor for conducting the balanced signal with a second polarity opposite the first polarity, the second conductor being inductively coupled to the third conductor substantially along the length of the third conductor;

a planar first ferrite layer spaced from the first and third conductors and extending continuously from opposite to the first major face of the first conductor to opposite to the first major face of the third conductor in a first plane parallel to the planes of the first and third conductors; and a planar second ferrite layer spaced from the first and third conductors and extending continuously from opposite to the second major face of the first conductor to opposite to the second major face of the third conductor in a second plane parallel to the planes of the first and third conductors, the first and third conductors being disposed between the first and second ferrite layers;

the second conductor being spaced from the first and third conductors and spaced from the first and second ferrite layers, the second conductor including planar first and second conductor layers, the first conductor layer extending opposite and along the first major faces of the first and third conductors in a third plane parallel to the planes of the first and third conductors and disposed between the first ferrite layer and the first and third conductors, and the second conductor layer extending opposite and along the second major faces of the first and third conductors in a fourth plane parallel to the planes of the first and third conductors and disposed between the second ferrite layer and the first and third conductors, the second conductor also including portions extending between the first and second conductor layers spaced from the first and third conductors.

8. The balun of claim 7, wherein the second conductor, including the first and second conductor layers, surrounds a corresponding portion of the first conductor.

9. The balun of claim 8, wherein the second conductor, including the first and second conductor layers, also surrounds a corresponding portion of the third conductor.

10. The balun of claim 7, wherein the second conductor includes at least first and second spaced-apart conductor segments extending serially between the first and second ends of the second conductor and surrounding the first and third conductors, with each conductor segment including respective segments of the first and second conductor layers.

* * * * *